United States Patent [19]

Klepacki

[11] Patent Number: 5,042,374

[45] Date of Patent: Aug. 27, 1991

[54] TRASH RECEPTACLE COMPACTOR

[76] Inventor: Frank H. Klepacki, 724 Pinecrest Ct., Ruth Lake Woods, Hinsdale, Ill. 60521

[21] Appl. No.: 417,646

[22] Filed: Oct. 5, 1989

[51] Int. Cl.[5] ..... B30B 15/06; B30B 1/02

[52] U.S. Cl. ..... 100/229 A; 100/266; 100/293

[58] Field of Search ..... 100/226, 227, 229 A, 100/266, 268, 293, 215, 255, 233, 245

[56] References Cited

U.S. PATENT DOCUMENTS

| | | | |
|---|---|---|---|
| 710,837 | 10/1902 | Bridger | 100/266 X |
| 987,913 | 3/1911 | Reeves | 100/266 X |
| 2,392,604 | 1/1946 | Mallory | 100/226 X |
| 2,478,815 | 8/1949 | Forman | 100/229 A X |
| 3,438,322 | 4/1969 | Marasco | 100/226 X |
| 3,841,214 | 10/1974 | Engebretson | 100/229 A X |
| 3,919,932 | 11/1975 | Basuino | 100/266 X |
| 4,286,515 | 9/1981 | Baumann et al. | 100/266 X |

FOREIGN PATENT DOCUMENTS

| | | | |
|---|---|---|---|
| 2326725 | 12/1974 | Fed. Rep. of Germany | 100/226 |
| 2912851 | 10/1980 | Fed. Rep. of Germany | 100/226 |

*Primary Examiner*—Harvey C. Hornsby
*Assistant Examiner*—Stephen F. Gerrity
*Attorney, Agent, or Firm*—Lloyd L. Zickert

[57] ABSTRACT

A trash receptacle compactor for compacting trash in a trash receptacle enclosed in a housing, including a plunger disposed within the housing in alignment with the trash receptacle and lever means outside of the housing and interconnected with the plunger for selectively operating the plunger to compact trash within the receptacle.

2 Claims, 3 Drawing Sheets

TRASH RECEPTACLE COMPACTOR

This invention relates in general to a compactor for compacting trash in a receptacle enclosed within a housing having an access door for the ingress of trash into the receptacle.

BACKGROUND OF THE INVENTION

The accumulation of trash in fast-food restaurants where the trash is generally light in weight because of containing drinking cups and molded food containers requires use of many plastic trash bags and considerable labor in handling the bags to maintain the trash receptacles at a level for receiving further trash. Further, considerable storage area is necessary in order to store the trash until it is removed by a disposal service.

The usual trash receptacles are initially lined with a plastic trash bag to receive the trash, and once the bag is full, it is necessary to close and tie off the bag and replace it with another empty bag. It is also necessary to take the bag full of trash to a disposal service area for storage until the disposal service removes the trash. The rapid build-up of trash requires manual handling of the trash bags on a frequent basis and thereafter the storage of those filled trash bags. Accordingly, a large enough storage area must be provided so as to accommodate storage of the trash bags prior to removal by a disposal service.

The trash receptacles or containers are normally enclosed within a housing having a counter surface over the top, a hinged ingress door along a side wall movable to allow the insertion of trash within the housing and into a trash receptacle, and an access door along a side wall for allowing access within the housing to remove the trash container and promote closing of the plastic bag and removal of the plastic bag full of trash and the subsequent replacement of an empty bag so that the receptacle is restored for receiving further trash.

Because of the frequent need to service the trash receptacle by removing a plastic bag filled with trash and replace it with an empty bag, it is necessary to provide the proper labor for carrying out that operation and properly servicing the trash receptacles for receiving further trash; and a rapid build-up of filled trash bags requires the need for a storage area that will accommodate the bulk of bags prior to removal by a disposal service.

SUMMARY OF THE INVENTION

The present invention is in a trash receptacle compactor that facilitates the compacting of light-weight and "airy" trash to reduce the number of plastic bags used for handling a given amount of trash and to reduce the labor involved in transporting filled trash bags to a storage area and to reduce the amount of storage area needed for handling trash at a fast-food restaurant.

The compactor of the present invention coacts with a housing for a trash receptacle in order to compact trash in the receptacle during the build-up of trash to thereby reduce the number of times needed to remove a trash-filled bag from a receptacle, insert an empty bag, and transport the trash-filled bag to a storage area. The compactor is constructed to be mounted on the housing for a trash receptacle by disposing a compacting plunger within the receptacle or engaging and compacting the trash in the trash receptacle and having an actuating handle or lever mounted exteriorly of the housing for manual actuation periodically to accomplish the trash compacting functions. The compactor mechanism may be added to present trash receptacle housings or mounted on newly manufactured housings.

The compactor of the invention may also be utilized with chemical bonding or staining agents or chemicals for destroying the integrity of paper documents where it may be desired to destroy papers for security purposes.

It is therefore an object of the present invention to provide a new and improved trash receptacle compactor for compacting trash in trash receptacles enclosed within housings where the trash is received within plastic trash bags held by the receptacles.

Another object of the present invention is to provide a trash receptacle compactor that will result in the reduction of the number of plastic bags used in a trash receptacle and will result in the amount of labor needed to attend to the servicing of the trash receptacle, and that will decrease the storage space needed for filled trash bags prior to removal by a disposal service.

A further object of the invention is to provide a compactor for a trash receptacle enclosed within a housing where the compactor may be added on to existing housings.

Another object of the invention is in the provision of a compactor for a trash receptacle enclosed within a housing that is mounted on the housing and provided with the housing at the time of purchase by a user.

Still another object of the invention is to provide a new and improved trash compactor for use in more efficiently handling trash in fast-food restaurants where trash build-up requires considerable attention.

Other objects, features and advantages of the invention will be apparent from the following detailed disclosure, taken in conjunction with the accompanying sheets of drawings, wherein like reference numerals refer to like parts.

DESCRIPTION OF THE INVENTION

Figure 2:
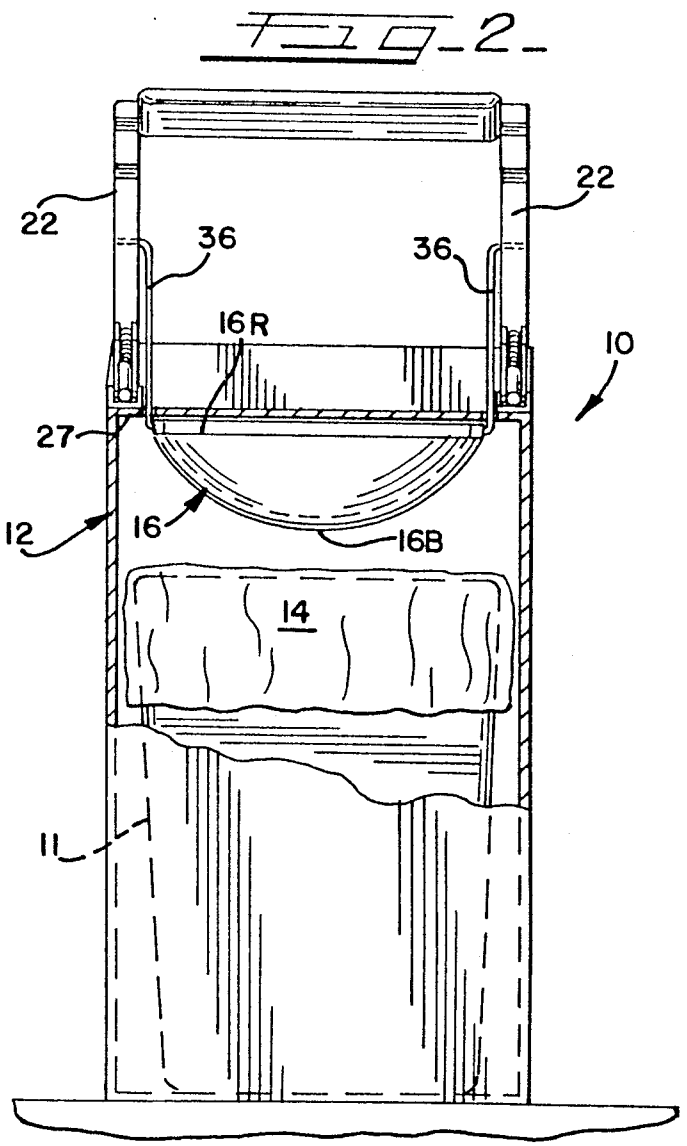
FIG. 2 is a front elevational view of the apparatus shown in FIG. 1, partly sectioned.
Figure 1:
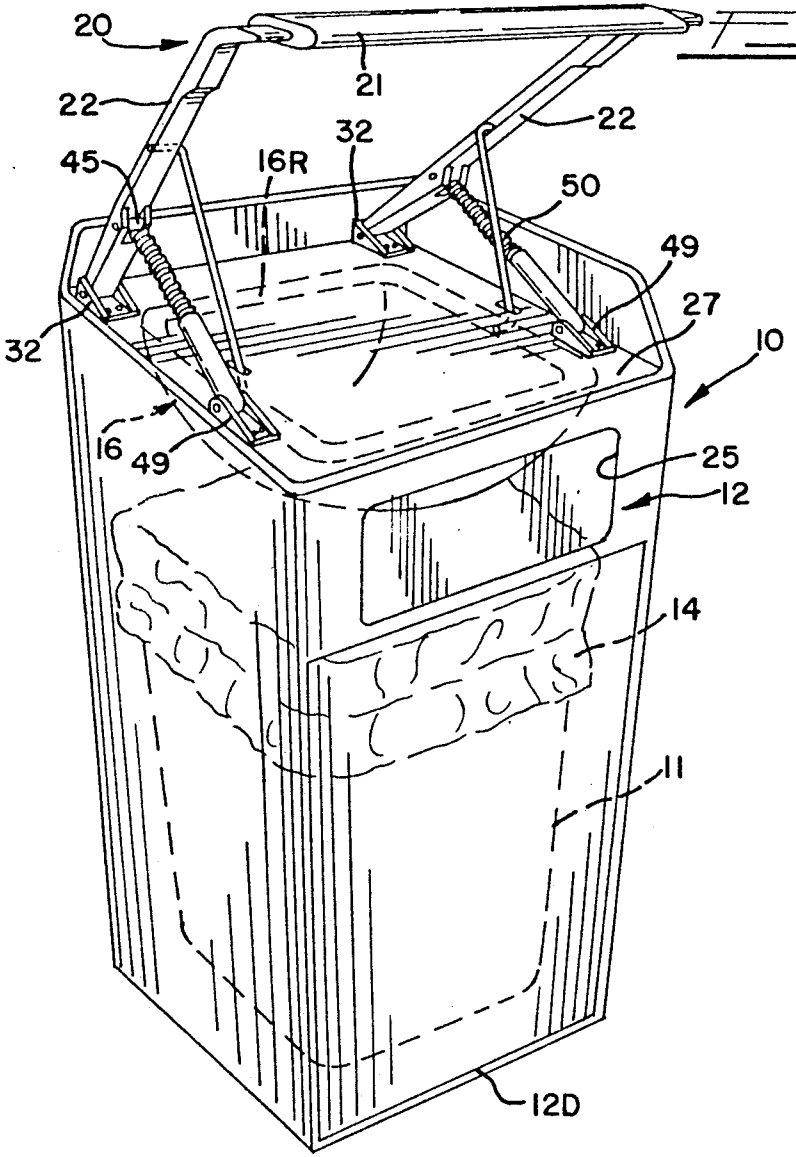
FIG. 1 is a perspective view showing the trash compacting apparatus of the present invention, including the plunger operating handle and lever support in its raised, normal position.

Referring to FIGS. 1 and 2, the assembled parts and apparatus for compacting trash is identified by reference character 10. Considered collectively, an open-ended trash container or receptacle 11 is located or positioned inside a housing 12 by which the trash container is hidden for cosmetic purposes, especially in a restaurant or fast-food dining area.

Ordinarily, the container as generally used will be lined with a plastic bag 14 which when filled is removed and carried to a dumpster or other trash bin.

Trash bags such as the foregoing, 14, are quickly filled, requiring nearly constant attention, due to light-weight plates, cups, napkins and so on, which is to say that for the most part empty air space is involved.

Under and in accordance with the present invention, a normally elevated compacting plunger 16 is located within the housing 12, above the upper or open end of the trash bag 14. The plunger is so supported and arranged that it may be manually advanced in the downward, compacting direction, repeatedly to lower the trash level until it is determined that a full, effective level has been reached. Further, the arrangement is such that the plunger is linked for reciprocal up-and-down motion to a lever system including a generally U-shaped plunger operating handle 20 which includes a bale 21 joined to a pair of rearwardly extending arms 22. A spring force, as will be described, normally holds or biases the handle in the raised position, as shown in FIGS. 1 and 2, and produces return action of the handle to the normal position after the compacting thrust has been exerted by the plunger 16.

Referring again to FIG. 1, a housing such as 12 will normally be present in the restaurant or fast-food dining area, presenting a front trash access opening 25 which the customer uses to empty a food tray, or the food tray may be emptied by a busboy or other attendant. Also, the trash can or container 11 and its liner 14 are normally present and, when filled, may be removed by opening a hinged door 12D, as shown in FIGS. 1 and 5, at the front of the housing 12.

The plunger 16, while it may have various geometric configurations, will have a perimeter and solid surface of such dimension and form that it can be effectively thrust into the open end of the container 11, whether or not a plastic liner such as 14 is present. Preferably, the plunger 16 is somewhat bowl-shaped, as can be readily recognized in FIGS. 1 and 2, with a convex bottom 16B, serving to assure effective entry into the open end of the container. Again, the preference is that the plunger 16 will have a generally rectangular top 16R such that when the plunger is in its fully advanced, compacting position, the perimeter 16R is complemental to the rectangular outline of the open end of the container 11, fitting neatly therein.

The lever support mechanism for advancing and retracting the plunger 16 is supported on the top 27 of the housing 12. Again, the arrangement is such that the handle and operating lever mechanism are normally spring urged to a raised or elevated position while allowing manual actuation of the plunger in the downward or effective advancing direction.

Figure 5:
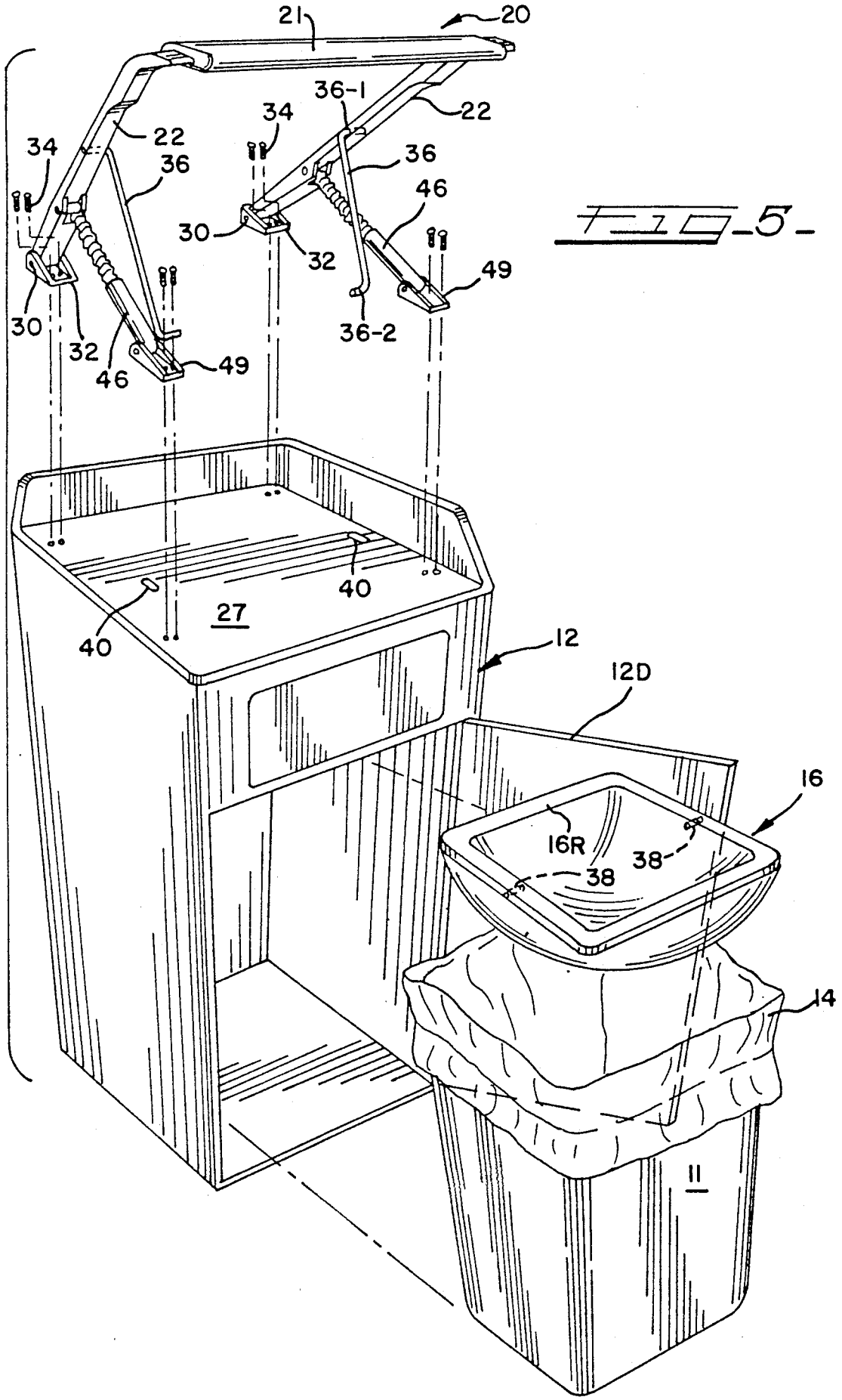
FIG. 5 is an exploded perspective view showing the parts disassembled and the relationship of the apparatus as a whole.

To this end, the free ends of the arms 22, the ends opposite the bale or handle 21, are pivotally supported on the top of the housing 27, preferably accomplished by pivoting the free ends of the arms 22 on pins 30, FIG. 5, in turn supported by a pair of brackets 32 secured by screws 34 to the top of the housing 27 at the rear corners thereof, as shown in FIG. 1.

Reciprocal movement of the plunger 16 is accomplished by flexibly joining the handle or lever mechanism to the plunger 16. Preferably, this is accomplished by a pair of swing links 36, FIGS. 1 and 5. Each link has an upper outwardly bent end 36-1, FIG. 5, inserted into a corresponding opening approximately midway of the length of the related arm 22, and there is an inwardly bent end 36-2 positioned pivotally in a corresponding opening 38 approximately midway of the opposed sides of the upper rectangular perimeter 16R of the plunger 16, as best shown in FIG. 5.

The swing links have free movement within elongated slots 40 in the top of the housing 27, as best shown in FIG. 5.

Figure 4:
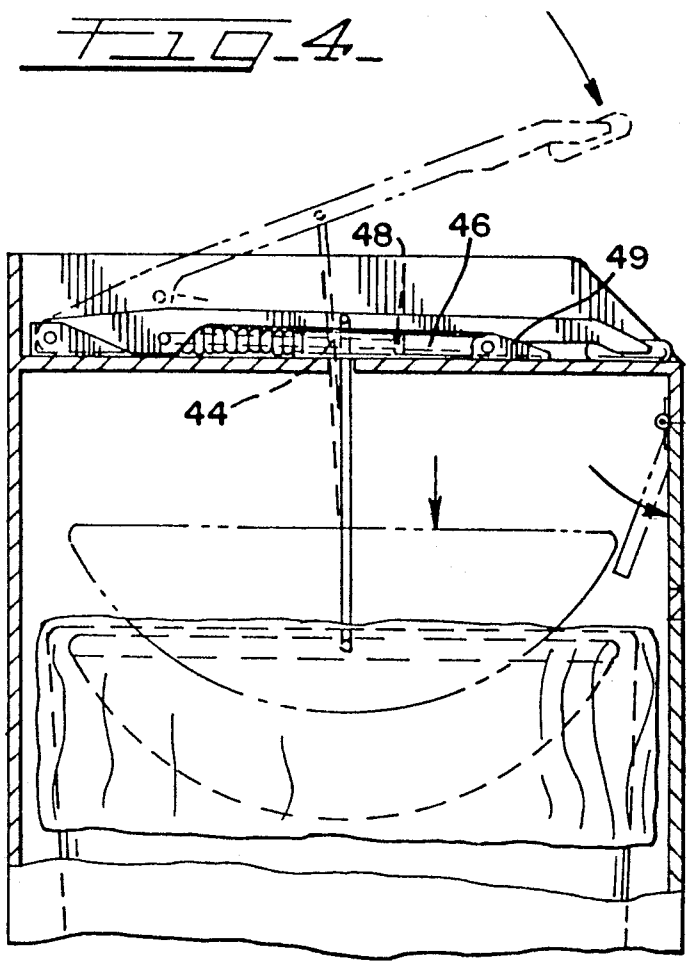
FIG. 4 is a side elevational view of the apparatus shown in FIG. 3, enlarged and broken away, showing the depressed position of the trash compacting plunger and the corresponding position of the operating handle.

The handle, when released after compaction, is spring returned to the normal, elevated position shown in FIGS. 1 and 2. This form of return is combined with a guide means for stabilizing and accurately directing the handle movement, the plunger and action of the lever combination including the swing links 36. To this end, a pair of guide rods as 44, FIG. 4, are pivotally attached by bushing pins 45, FIGS. 1 and 3, to the handle arms 22, constituting a lever system, as will be apparent in FIG. 5. The opposite ends of the guide rods are captured coaxially inside a related pair of guide cylinders 46, captured coaxially and guided by a limiting stop 48 inside each related cylinder, FIG. 4. The opposite end or front of each cylinder 46 is pivotally attached to a related bracket 49, FIGS. 1 and 5, and these brackets are secured by screws to the top of the housing 12, near the front corners.

Coil springs 50 are respectively mounted concentrically about the guide rods, effectively bearing against the bushings 45 at one end, and at the opposite end against the guide rod cylinders, normally to elevate the lever mechanism and the plunger.

Figure 3:
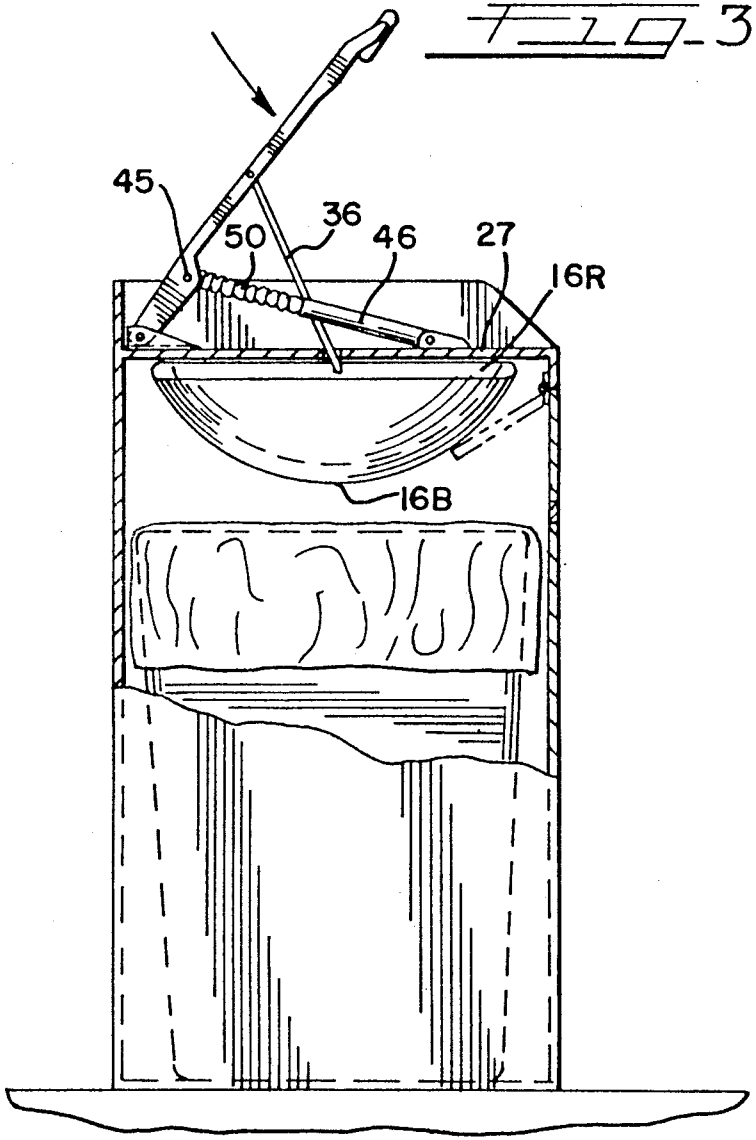
FIG. 3 is a side elevational view of the apparatus shown in FIG. 1, partly sectioned.

As shown in FIG. 4, when the handle is lowered to activate the plunger, the springs 44 are compressed between the handle bushings 45 and the end of the guide cylinders 46 opposite the securement brackets 48. When the handle is released, the springs expand to elevate the handle, as shown in FIG. 3.

It will be seen from the foregoing that the compacting apparatus, including the plunger 16 and its spring-biased lever mechanism, are readily accommodated to a housing in which is located the trash receiver, container, bag, combination of container and bag, or other receptacle having an open end to which the solid or butt end of the plunger is configured complementally. Repeated compacting motion of the plunger allows the attendant to utilize the full capacity of the receptacle, reducing the number of trips required to dispose of the filled trash receptacle. While the trash contemplated under the present invention in most instances will be fast-food garbage, paper and throw-away table service, the compacting apparatus may be used to compact other trash, shredded documents, unnecessary computer print-outs, and so on. Indeed, the compactor may be used to stain or otherwise obliterate printed matter. Thus, the word "trash" is used herein in the sense of worthless, paper-like rubbish easily pressed to eliminate air. It will also be appreciated that while a compacting plunger and manually operated lever system with a spring return means connected thereto have been shown in the preferred geometric form, equivalent connections may be adopted, and the spring means altered, within the purview of the appended claims.

I claim:

1. In combination with a receptacle having an upper open end, a trash compacting apparatus mounted on said open end for repeatedly compacting loose trash in said receptacle comprising: a plunger configured generally to fit complementally in the open end of the receptacle; a plunger operating lever mechanism which supports the plunger for actuated compacting movement into and return movement out of the receptacle including, a manually operable handle and handle support to be pivotally attached to the receptacle; means joining the handle as an operating lever to the plunger to activate the plunger, said lever means including swing links joining the handle and the plunger; and spring return means for the handle to elevate the handle when released, said spring return means being combined with guides which guide, direct and stabilize movement of the handle and plunger, and said guides being cylinders to be pivotally attached to the housing, guide rods coaxial with the cylinders, and having ends pivotally attached to the handle, and coil springs surrounding the guide rods to return the handle.

2. In combination with a receptacle received in a housing and having an upper open end, the dimensions of the receptacle being complemental to the housing, an apparatus mounted on the open end of the receptacle for compacting build-up of trash in said receptacle comprising: a plunger juxtaposed to said open end and sized complementally with said receptacle open end; and a lever support for said plunger normally locating the plunger above the top of said open end, allowing a manual thrust on the plunger to advance the plunger into the receptacle to compact trash therein while allowing return of the plunger to its normal position following manual compaction, said lever support being attached to and mounted on said housing, and said housing having an opening therein to allow trash to be thrust into the receptacle, and said housing including a top, in which the lever support comprises a generally U-shaped spring handle having a pair of arms pivotally mounted to the top of the housing, a pair of guide cylinders each pivotally supported at one end on the top of the housing and containing guide rods pivotally attached to said arms, and coil springs encompassing said rods to apply a force to position the handle in a normal elevated position when the plunger is above the trash level of the receptacle.

* * * * *